US006648059B2

(12) United States Patent
Lindgren

(10) Patent No.: US 6,648,059 B2
(45) Date of Patent: Nov. 18, 2003

(54) METHOD FOR DETECTING A ROLLER FAILURE

(75) Inventor: Håkan Lindgren, Göteborg (SE)

(73) Assignee: Aktiebolaget SKF, Gothenburg (SE)

( * ) Notice: Subject to any disclaimer, the term of this patent is extended or adjusted under 35 U.S.C. 154(b) by 0 days.

(21) Appl. No.: 10/079,574

(22) Filed: Feb. 22, 2002

(65) Prior Publication Data

US 2002/0121426 A1 Sep. 5, 2002

(51) Int. Cl.[7] ..... B22D 11/20
(52) U.S. Cl. ..... 164/454; 164/151
(58) Field of Search ..... 164/454, 413, 164/151, 448, 442

(56) References Cited

U.S. PATENT DOCUMENTS

| | | | | |
|---|---|---|---|---|
| 3,557,865 A | * | 1/1971 | Gallucci et al. | 164/150.1 |
| 3,937,271 A | | 2/1976 | Akiba et al. | |
| 4,056,140 A | * | 11/1977 | Ives et al. | 164/454 |
| 4,211,273 A | * | 7/1980 | Scheurecker | 164/150.1 |
| 4,317,482 A | * | 3/1982 | Wolf | 164/454 |
| 4,497,360 A | * | 2/1985 | Bercovici | 164/454 |
| 6,427,758 B1 | * | 8/2002 | Klassen | 164/454 |

FOREIGN PATENT DOCUMENTS

| | | | |
|---|---|---|---|
| DE | 2 427 895 | | 12/1994 |
| FR | 2 689 046 A1 | | 10/1993 |
| GB | 2 019 017 A | | 10/1979 |
| JP | 57-041868 A | * | 3/1982 |
| JP | 58-184053 A | * | 10/1983 |
| JP | 62-130759 A | * | 6/1987 |

* cited by examiner

*Primary Examiner*—Kuang Y. Lin
*Assistant Examiner*—Kevin McHenry
(74) *Attorney, Agent, or Firm*—Burns, Doane, Swecker & Mathis, LLP

(57) ABSTRACT

A method for detecting a roller failure at a roller in a continuous casting machine having a plurality of rollers arranged in a row and rotatably supported in bearings for transporting material produced in the machine involves determining a radial target load value exerted by the material on a roller, measuring the actual load value on at least each second roller in the row of rollers, comparing the measured actual load value with the determined target load value, detecting a possible divergence between the actual load value and the target load value, and establishing the presence of a roller failure upon detection of such divergence.

14 Claims, 2 Drawing Sheets

METHOD FOR DETECTING A ROLLER FAILURE

This application is based on and claims priority under 35 U.S.C. §119 with respect to Swedish Application No. 0100612-1 filed on Feb. 22, 2001, the entire content of which is incorporated herein by reference.

FIELD OF THE INVENTION

This invention generally relates to a method of detecting a failure in a roller. More particularly, the invention pertains to a method for detecting a roller failure at a roller in a continuous casting machine.

BACKGROUND OF THE INVENTION

A continuous casting machine produces steel material from molten steel. This steel material can, for example, be used as the starting material in rolling processes for producing sheet metal. The sheet metal can be used, for instance, in vehicles.

In the continuous casting machine, molten steel flows from a ladle and down in a tundish from which it is further transported down into a mold. In the mold, which is water-cooled, the slab of continuous cast material begins to form a solid shell. The slab is then continuously transported along a curved track by a large number of rollers arranged in segments which continue to shape and cool the slab to the final thickness of the steel material. At the end of the track, the material is cut into suitable pieces.

The rollers of the continuous casting machine are mounted with their axes substantially perpendicular to the longitudinal extension of the curved track. To be able to lead and support the slab of continuous cast material, the rollers are arranged in pairs, with each comprising an upper roller and a lower roller.

Further, the rollers are supported in bearings at each end of the rollers. Due to the length of the rollers, and thus their weight, the rollers are generally split into at least two roller portions. The roller portions are either independently supported in bearings or non-rotatably provided on a common shaft, with the shaft being supported in bearings.

A serious problem that can occur during continuous casting is that cracks can arise in the cast material due to roller failure. Such roller failures can mainly be caused by one or several bearing failures and/or mounting failures, both of which lead to one or several rollers no longer being aligned with the imagined extension of the track of rollers. A further cause can be excessive wear of one roller compared to the other rollers.

Generally speaking, a bearing and/or bearing housing failure refers to a failure that occurs during operation of the continuous casting machine and is often caused by loads exceeding permitted loads or wear in the bearings caused by, for example, dirt. A bearing and/or bearing housing failure is called a "collapse". The result of such a collapse is that the roller supported in the collapsed bearing and/or bearing housing cannot support the slab as much as before due to the fact that the position of the roller changes in direction substantially away from the slab. That is, the collapsed roller is no longer aligned with the imagined extension of the track of rollers and therefore the contact with the slab decreases. In those cases where the liquid core of the slab is very small, i.e., in the section of the machine where the slab is more or less entirely solidified, the roller loses all of its contact with the slab.

As used herein, a mounting failure refers to an initial misalignment of one or several rollers and/or segments compared to the imagined extension of the track of rollers. Usually, when setting up a machine, a number of rollers are first mounted together to form track segments. These segments are later lifted into the machine. This procedure saves assembly time because the frame of the machine and the track segments can be assembled simultaneously. Also, track segments are often assembled in advance and are kept standing by in case any segment in the machine needs to be rapidly exchanged due to failure.

When mounting together the rollers to form segments, the rollers within a segment are aligned to each other with conventional measuring equipment such as, for example, a ruler. However, when these segments are later mounted in the continuous casting machine, it is very likely that the alignment between the rollers in the segments might become more or less destroyed because of the size, weight and ungainliness of the segments. For the same reasons, it is also very likely that entire segments in the machine will not be correctly aligned with the imagined extension of the track of rollers, that is with segments that are correctly positioned in the track.

Because the size of the rollers and the segments in a continuous casting machine is very large and the divergence between the normal position of the roller and/or segment and the misaligned position is relatively small, it is usually very difficult to distinguish a misaligned roller and/or segment from the rest of the rollers and/or segments. This is unfortunate as the cracks arising from these misalignments (i.e., from less support or the sudden lack of material) can cause relatively great damage to the material.

These cracks can be either internal cracks or surface cracks, both of which lead to decreased quality as a material having cracks will be almost impossible to roll. Surface cracks can be treated by costly treatment after the casting process. One way of treating the surface cracks is to weld them. Another way to treat the surface cracks is to grind off the surface layer of the material. Both alternatives are expensive and cannot give a perfect result. The steel thus has to be classified in a lower quality class. Material with internal cracks cannot be treated and must be discarded.

A need thus exists for a method of detecting roller failures, for example bearing or mounting failures, at rollers and or segments in a continuous casting machine.

SUMMARY OF THE INVENTION

A method for detecting roller failures, e.g. bearing or mounting failures, at rollers and or segments in a continuous casting machine involves determining a radial target load value exerted by the material on a roller, measuring the actual load value on at least each second roller in the row of rollers, comparing the measured actual load value with the determined target load value, detecting a possible divergence between the actual load value and the target load value, and establishing the presence of a roller failure at such a divergence.

Another aspect involves a method for detecting a roller failure in a continuous casting machine that is comprised of a row of rollers supported in bearings and arranged one after another for transporting material produced in the machine. The method includes measuring an actual radial load value exerted by the material being transported on one of the rollers, comparing the measured actual radial load value with a target radial load value, detecting a divergence between the measured actual radial load value and the target radial load value, and determining that a failure of the roller exists upon detecting a divergence between the actual radial load value and the target radial load value.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
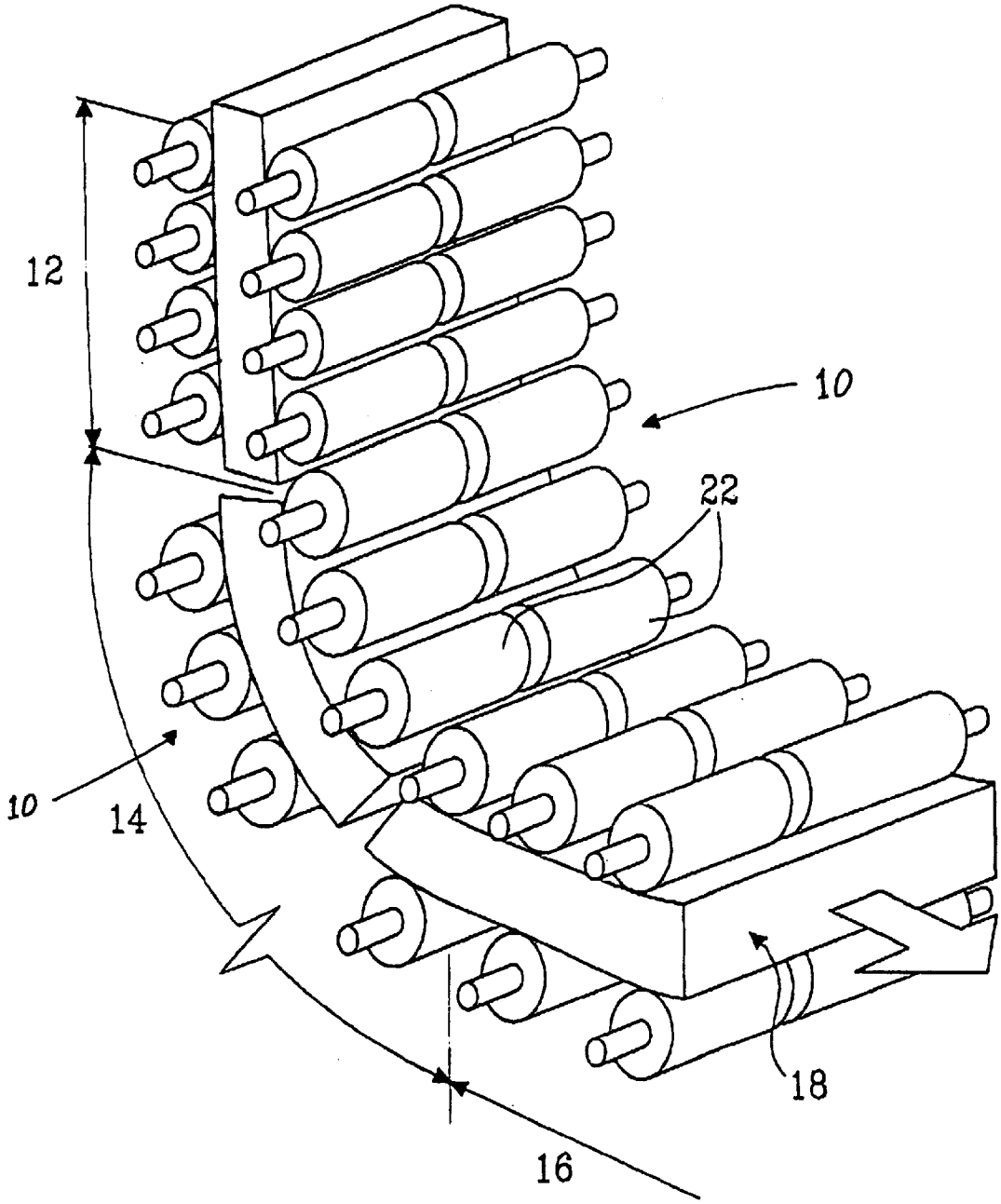
FIG. 1 is a perspective schematic view of a set of rollers of a continuous casting machine.

FIG. 1 illustrates a row of rollers 10 of a typical section of a continuous casting machine. The continuous casting machine includes a top segment 12, an inside cooling chamber 14, and an outside cooling chamber 16. The rollers 10 are arranged in pairs, with the pairs of rollers 10 leading and supporting the slab 18 of a continuous length of continuous cast material. In the top segment 12, the slab 18 has a more or less liquid core. During feeding under continuous movement in the direction shown by the arrow in FIG. 1, the slab 18 will solidify as it is cooled.

The rollers 10 are each mounted with their axes substantially perpendicular to the longitudinal extension of the track. The rollers 10 are rotatably supported in bearings at each end of each roller 10.

Generally speaking, the rollers 10 are split into at least two roller portions 22. The roller portions 22 forming each roller are positioned axially after each other (i.e., axially adjacent one another). The roller portions 22 are either independently supported in bearings or are non-rotatably positioned on a common shaft which is supported in bearings.

Figure 2:
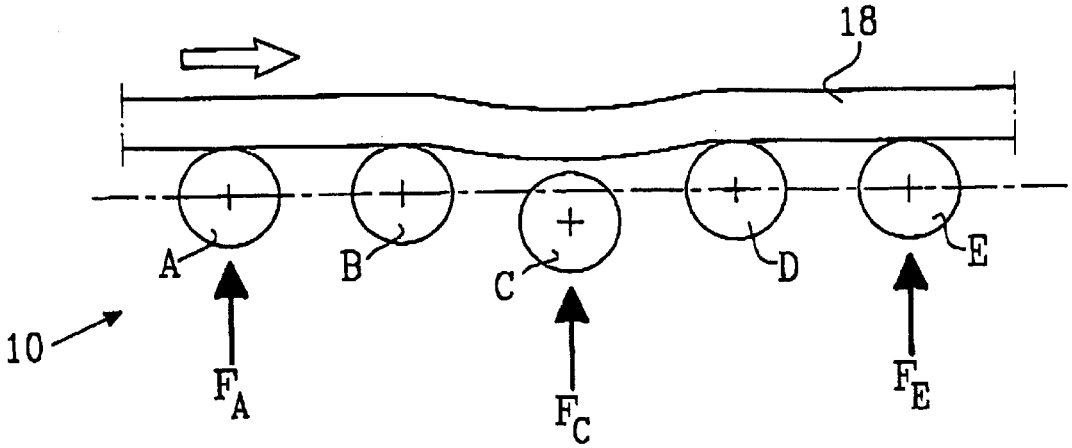
FIG. 2 is a side view schematically illustrating an embodiment of the invention and showing a portion of a slab being transported on a row of rollers in which row one roller C has collapsed due to a bearing failure, and in which the reaction forces FA, FC, FE of various rollers A, C, E are measured and indicated by arrows.

Referring to FIG. 2, an example of the present invention will be described according to a roller failure caused by a bearing collapse. As mentioned above, the cause of a roller failure can also be a mounting failure where one or several rollers in a segment can be initially misaligned to the imagined extension of the track of rollers. A further possibility referring to mounting failures is that an entire segment or segments can be misaligned in the machine. However, the way of detecting mounting failures is similar to that of detecting bearing failures.

The following example explains the principle of the invention in the context of only one row of rollers 10 in a continuous casting machine. To simplify the example, the rollers 10 are not split into portions.

In the continuous casting machine, the slab 18 of continuous cast material is transported along the row of rollers 10 in the direction indicated by the arrow. The principle of the invention is that as long as the load distribution on the rollers 10 is equal to or within the same load interval limits as the load distribution was from the beginning of the casting, it is determined that no bearings and/or bearing housings have collapsed. If, however, such a failure occurs, the load of the continuous cast material will be distributed over the rollers 10 in a slightly different pattern due to the fact that one or several rollers are unable to carry as much load as before or are unable to carry any load at all. This means that the neighboring rollers will also have to carry weight otherwise supported by the collapsed roller. Thus, such neighboring rollers will experience or be subjected to an increased load exceeding the normal load. Thus, by continuously measuring the load pattern, it is possible to detect collapsed rollers.

According to one version of the method, a measuring device is provided in at least one bearing or bearing housing of each roller 10. This measuring device is able to measure the radial force F acting in the bearing or bearing housing throughout the casting operation, due to the load of the slab 18 acting on the roller 10.

First, a determination is made of a first radial load, a target radial load value, which is the load of the material 18 exerted on a roller 10 when the roller 10 is in its normal position, i.e., when its bearings and bearing housings are not collapsed but are operating in the normal manner. The determination of this target radial load value can be made in at least two ways. The target radial load value may either be calculated in advance or measured by the measuring device after starting the casting process. In this embodiment of the invention, it is possible to determine the load value of each second roller 10 (i.e., every other roller 10).

Next, in order to be able to detect an eventual bearing and/or bearing housing failure during the casting process, a second radial load, an actual radial load value, is measured throughout the process at predetermined time intervals, for example each second. The actual load value is the momentary load of the slab 18 on the roller 10 at each measuring interval. Advantageously, this measuring is made at those rollers 10 where the target radial load value was determined.

After each actual load value measurement, the actual load value of at least each second roller 10 is compared with the respective determined target load value for the rollers 10. As long as the actual load values is equal to or within a load interval limit of the target load values, it can be interpreted that there is no occurrence of a bearing and/or bearing housing failure. When a divergence exists between the target load values and the actual load values, it can be interpreted that something has happened with the load pattern, most likely that one or several rollers 10 have collapsed due to a failure in its bearing and/or bearing housings.

As mentioned above, only every second roller 10 is measured in this embodiment of the method. As long as the target toad value and the actual load value of the respective roller are substantially constant, the load pattern is unchanged and it is determined that there is no occurrence of bearing failure. However, if there is a bearing failure, there will be a divergence between the target load value and the actual load value. This divergence can be either negative or positive depending on which rollers are measured.

With reference to FIG. 2, in the case of a negative divergence in which the actual load value F on a roller C is less than the target load value for that roller, it is obvious that the measured roller C is not able to carry as much load as before. The most reasonable cause of this is that the roller C has collapsed due to bearing and/or bearing housing failure. In other words, a negative divergence is established as a bearing failure at a roller on which the negatively diverging value has been measured.

Figure 3:
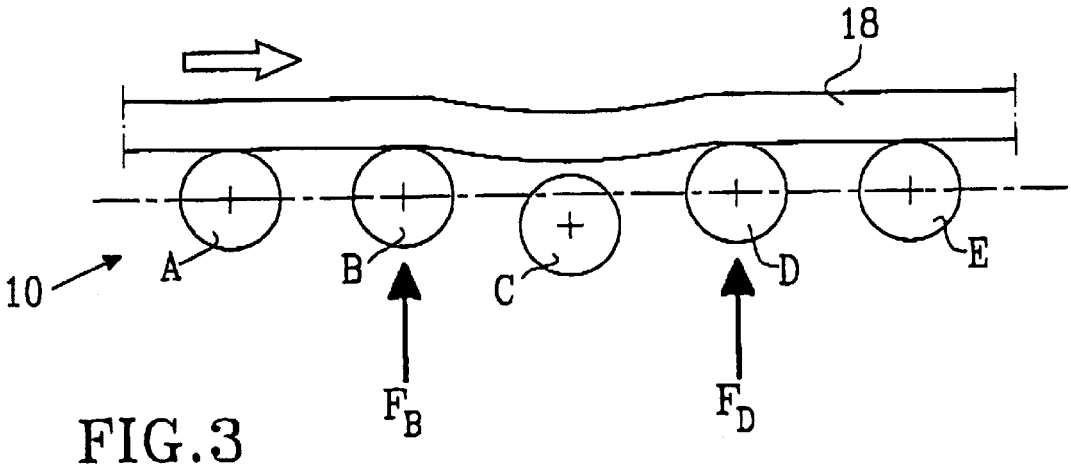
FIG. 3 is a side view similar to FIG. 2 in which the reaction forces FB, FD of other rollers B, D are instead measured.

When a roller has collapsed, for example roller C, and can no longer carry as much load as before, or cannot carry any load at all, the adjacent rollers B, D have to compensate for this loss by carrying more load than before. Therefore, the divergence can also be positive such as shown in FIG. 3, i.e. the actual load value FB on a roller B is greater than the target load value for that roller. Accordingly, rollers having a positive divergence, in this case rollers B and D, carry some extra load and the reason for that is that they are located adjacent a roller C that can no longer support the slab as much as before due to bearing and/or bearing housing failure. Thus it can be said that a positive divergence is established as a bearing failure at a roller adjacent the roller on which the positively diverging value has been measured.

In this description, an example of the invention have been described in which the detection of roller failures such as collapsed rollers is relatively simple to perform. However, in complex systems with several roll portions in each roller and/or where several rollers and/or roller portions are collapsed, the detection of collapses is carried out by "recognition" of load/force patterns by using suitable mathematical methods, the details of which are not explained here. Also, when the method described herein is used in connection with rollers divided into two roller portions positioned axially adjacent one another and individually supported in bearings as mentioned above, the actual load value can be measured on at least one bearing in each roller position.

The principles, preferred embodiments and methods of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A method for detecting a roller failure at a roller in a continuous casting machine, the continuous casting machine having a plurality of rollers arranged for transporting material produced in the machine, the rollers being arranged in a row one after another and rotatably supported in bearings, the method comprising:

determining a target load value exerted by the material on a roller;

measuring an actual load value on at least each second roller in the row of rollers;

comparing the measured actual load value with the determined target load value;

detecting a divergence between the actual load value and the target load value; and establishing a roller failure upon detecting a divergence between the actual load value and the target load value.

2. The method according to claim 1, wherein detection of a positive divergence is established as a roller failure at a roller adjacent the roller on which the positive divergence has been detected.

3. The method according to claim 2, including measuring the actual load value in the bearings or in bearing housings.

4. The method according to claim 1, wherein the detection of a negative divergence is established as a roller failure at the roller on which the negative divergence has been detected.

5. The method according to claim 4, including measuring the actual load value in the bearings or in bearing housings.

6. The method according to claim 1, wherein the rollers are divided into at least two roller portions positioned axially adjacent one another and individually supported in bearings, and the actual load value being measured on at least one bearing in each roller position.

7. A method for detecting a roller failure in a continuous casting machine that is comprised of a row of rollers supported in bearings and arranged one after another for transporting material produced in the machine, the method comprising:

measuring an actual radial load value exerted by the material being transported on one of the rollers;

comparing the measured actual radial load value with a target radial load value;

detecting a divergence between the measured actual radial load value and the target radial load value; and determining that a failure of the roller exists upon detecting a divergence between the actual radial load value and the target radial load value.

8. The method according to claim 7, wherein the actual radial load value is measured in the bearings or in bearing housings.

9. The method according to claim 7, wherein detection of a positive divergence between the measured actual radial load value and the target radial load value determines a failure of the roller adjacent the roller on which the positive divergence was detected.

10. The method according to claim 9, wherein the actual radial load value is measured in the bearings or in bearing housings.

11. The method according to claim 7, wherein detection of a negative divergence between the measured actual radial load value and the target radial load value determines a failure of the roller on which the negative positive divergence was detected.

12. The method according to claim 11, wherein the actual radial load value is measured in the bearings or in bearing housings.

13. The method according to claim 7, wherein the rollers are divided into at least two roller portions positioned axially adjacent one another and individually supported in bearings, and the actual load value is measured on at least one bearing in each roller position.

14. The method according to claim 7, wherein the actual radial load value is measured in every other roller in the row.

* * * * *